United States Patent [19]

Miller

[11] Patent Number: 4,617,105

[45] Date of Patent: Oct. 14, 1986

[54] COAL LIQUEFACTION PROCESS USING PRETREATMENT WITH A BINARY SOLVENT MIXTURE

[75] Inventor: Robert N. Miller, Allentown, Pa.

[73] Assignee: Air Products and Chemicals, Inc., Allentown, Pa.

[21] Appl. No.: 780,506

[22] Filed: Sep. 26, 1985

[51] Int. Cl.[4] ..... C10G 1/00; C10G 1/06

[52] U.S. Cl. ..... 208/412; 208/403; 208/415; 208/430; 208/435

[58] Field of Search ..... 208/8 LE, 10

[56] References Cited

U.S. PATENT DOCUMENTS

| | | | |
|---|---|---|---|
| 1,822,349 | 9/1931 | Jonnek et al. | 208/8 LE |
| 2,133,280 | 10/1938 | Burk | 208/8 LE X |
| 3,254,959 | 6/1966 | Fallgatter et al. | 208/8 LE X |
| 3,503,860 | 3/1970 | Skripek et al. | 208/10 |
| 3,637,639 | 1/1972 | Zinniel et al. | 260/107 |
| 3,692,662 | 9/1972 | Wilson et al. | 208/8 |
| 3,726,784 | 4/1973 | Correa et al. | 208/8 |
| 3,884,794 | 5/1975 | Bull et al. | 208/8 |
| 3,884,795 | 5/1975 | Wright et al. | 208/8 |
| 3,884,796 | 5/1975 | Hinderliter et al. | 208/8 |
| 4,028,221 | 6/1975 | Sze et al. | 208/8 |
| 4,030,893 | 6/1977 | Keller | 208/8 LE X |
| 4,085,031 | 4/1978 | Walchuk | 208/8 |
| 4,089,658 | 5/1978 | Bay | 44/56 |
| 4,102,774 | 7/1978 | Carr et al. | 208/10 X |
| 4,111,663 | 9/1978 | Wolk et al. | 422/191 |
| 4,124,485 | 11/1978 | Carr et al. | 208/10 X |
| 4,180,452 | 12/1979 | Sinor | 208/8 LE |
| 4,192,651 | 3/1980 | Keller | 208/8 LE X |
| 4,250,014 | 2/1981 | Long et al. | 208/8 LE |
| 4,255,258 | 3/1981 | Carr et al. | 208/8 LE X |
| 4,272,356 | 6/1981 | Stiller et al. | 208/8 LE |
| 4,298,450 | 11/1981 | Rose et al. | 208/10 X |
| 4,298,452 | 11/1981 | Dorawata et al. | 208/8 LE |
| 4,344,837 | 7/1982 | Komiyama et al. | 208/8 LE |
| 4,374,023 | 2/1983 | Davis | 208/8 LE X |
| 4,388,171 | 6/1983 | Corcoran et al. | 208/8 LE |
| 4,425,135 | 1/1984 | Jenkins | 208/8 LE X |
| 4,434,043 | 2/1984 | Senghol et al. | 208/10 |
| 4,447,310 | 5/1984 | Derbyshire et al. | 208/8 LE |
| 4,473,462 | 9/1984 | Swanson | 208/10 |

FOREIGN PATENT DOCUMENTS

| | | | |
|---|---|---|---|
| 3013066 | 10/1981 | Fed. Rep. of Germany | 208/8 LE |
| 54-124005 | 9/1979 | Japan | 208/8 LE |

*Primary Examiner*—Andrew H. Metz
*Assistant Examiner*—William G. Wright
*Attorney, Agent, or Firm*—Geoffrey L. Chase; E. Eugene Innis; James C. Simmons

[57] ABSTRACT

An improved process for thermal solvent refining or hydroliquefaction of non-anthracitic coal at elevated temperatures under hydrogen pressure in a hydrogen donor solvent comprises pretreating the coal with a binary mixture of an aromatic hydrocarbon and an aliphatic alcohol at a temperature below 300° C. before the hydroliquefaction step. This treatment generally increases both conversion of coal and yields of oil.

17 Claims, 1 Drawing Figure

COAL LIQUEFACTION PROCESS USING PRETREATMENT WITH A BINARY SOLVENT MIXTURE

TECHNICAL FIELD

The Government of the United States of America has rights in this invention pursuant to Contract No. DE-AC22-82-PC50003 awarded by the U.S. Department of Energy.

The present invention is directed to a process for making synthetic fuels from non-anthracitic coals. The process relates to producing liquid hydrocarbons and normally solid solvent-refined coal from raw mined coal, which has not been substantially pretreated. The present process is directed to improved solvent refining or coal liquefaction processes, in which the coal is pretreated at relatively low temperatures in a binary solvent mixture, before the hydroliquefaction step in the presence of a hydrogen donor solvent at high temperature under hydrogen pressure.

BACKGROUND ART

The art of coal treatment to upgrade coal and provide alternative fuels, particularly liquid fuels to replace petroleum-derived liquid fuels, was first studied intensively in Germany in the 1920's. Research in the technology of coal upgrading has continued up to the present time, and was particularly active during the worldwide oil shortages of the 1970's.

Techniques for recovering more-easily utilized fuels from raw coal are generally known as coal liquefaction. Coal liquefaction can employ a wide variety of non-anthracitic substrates, particularly bituminous, subbituminous and lignitic coals. Other organic materials, e.g., peat can also be used.

Coal liquefaction processes broadly include both thermal (non-catalytic) and catalytic procedures. In thermal processes, heat is used to liquefy the coal without addition of extraneous catalytic materials. In thermal coal liquefaction processes, however, minerals, especially iron-bearing species, naturally found in the coal substrate may function as catalysts for the process. Both catalytic and non-catalytic coal liquefaction processes can be performed in a variety of reactors, including slurry phase reactors and fluidized bed reactors.

Coal liquefaction processes attempt to bring about cleavage of weak heteroatom to carbon and stronger carbon to carbon linkages in the coal structure. In the context of coal liquefaction, heteroatoms include nitrogen, oxygen and sulfur, bonded in any fashion to carbon of coal. The intermediate free radicals, resulting from cleavage of carbon-heteroatom and carbon-carbon bonds, are hydrogenated during liquefaction to prevent polymerization of the thus-produced free radicals to high molecular weight structures.

Although hydrogen performs the necessary function of hydrogenation in coal liquefaction, it has been found that introduction of hydrogen by a hydrogen donor solvent is preferable to use of gaseous hydrogen alone. Hydrogen donor solvents must dissolve the products from coal liquefaction and must be capable of reversible hydrogenation and dehydrogenation. The donor solvent therefore functions as a hydrogen carrier, upon which hydrogen is loaded and introduced into the reaction mixture. Hydrogenated donor solvent then transfers hydrogen to free radicals generated during coal liquefaction and the hydrogen-depleted solvent is separated from the products and is rehydrogenated before recycling to the coal liquefaction reaction.

Corcoran et al. (U.S. Pat. No. 4,388,171) have disclosed extraction of coal under supercritical conditions with a solvent mixture, characterized by molecular diameter with respect to the pore size of the coal being treated. The use of a mixture of polar and non-polar solvents is proposed.

Zinniel et al., in U.S. Pat. No. 3,637,639, have proposed extraction of resinous materials from coal by a series of solvent-extraction and solvent-separation steps, particularly using a mixture of hexane and chloroform.

Stiller et al. have proposed, in U.S. Pat. No. 4,272,356, extraction of coal with highly polar solvents, such as dimethyl acetamide and hexamethyl phosphoramide. A deficiency of the process is the difficulty in recovering solvent for recycling.

Sze et al., in U.S. Pat. No. 4,028,221, have proposed pretreating sub-bituminous or lignitic coal, intended for hydroliquefaction or solvent refining, by removing at least 10% of organic oxygen in the coal being used. The organic oxygen is removed by soaking the coal at 288°–400° C. in a pasting solvent derived from the hydroliquefaction process. A stated advantage of removing organic oxygen from the coal is reduction in the amount of hydrogen required for the liquefaction reaction.

Bay (U.S. Pat. No. 4,089,658) has disclosed extracting coal with a mixture of water, carbon tetrachloride and one or more additional organic solvents. The extract is used as a fuel additive.

Heating a wet coal slurry at 100°–350° C. in the presence of a solvent has been recited by Komiyama et al., in U.S. Pat. No. 4,344,837, as a way of dehydrating wet coal.

Wilson et al. (U.S. Pat. No. 3,692,662), have recited a two-step process for hydroliquefaction, in which the coal is first treated in a hydrogen-donor solvent slurry at temperatures of 260°–370° C. and agitated until the viscosity of the slurry indicates that dispersion is complete. The reference represents that use of a thus-formed dispersion for hydroliquefaction gives higher yields of liquefaction products. It will be appreciated that the temperatures used are above the lower limit, at which depolymerization of coal occurs.

The use of a hydrogen donor solvent, in the vapor phase, to swell coal particles before liquefaction has been proposed by Long et al. (U.S. Pat. No. 4,250,014). The swollen coal particles are then subjected to liquefaction conditions, in the presence of a liquid-phase solvent. Pretreatment with a hydrogen donor solvent, e.g. tetralin, is reported to have no effect on coal conversion, but treatment with tetrahydroquinoline is cited as giving significantly higher coal conversions.

Prior art references, teaching solvent pretreatment of coal before solvent refining accordingly teach, in many cases, pretreatment at temperatures as high as, or higher than, those used for hydroliquefaction. The processes may be commercially unacceptable because of requirements for high temperatures or pressures or because, as a result of high temperatures or pressures employed, the coal residue takes on a refractory character, and does not readily undergo further processing with a hydrogen donor solvent.

It is therefore an object of this invention to provide a method for pretreating feed for hydroliquefaction reactions, in which coal is subjected to relatively low-temperature extraction with a binary solvent mixture, to produce feed which gives enhanced oil yields during subsequent hydroliquefaction.

DISCLOSURE OF INVENTION

This invention relates to an improved process for thermal solvent refining of coal at an elevated temperature and pressure in the presence of hydrogen and a hydrogen donor solvent, boiling at above about 230° C., to produce liquid hydrocarbons and normally solid solvent-refined coal, wherein the improvement comprises extracting the coal feed with a binary mixture of an aromatic hydrocarbon of up to 9 carbon atoms and an alkanol of up to 6 carbon atoms at a temperature below about 300° C., before solvent refining the coal.

Hydroliquefaction or solvent refining of coal, in accordance with the present invention, may be done by a variety of known processes, particularly thermal processes, e.g. Exxon donor solvent as taught by U.S. Pat. Nos. 3,726,784, 4,085,031; SRC-I as recited in U.S. Pat. No. 4,111,663; SRC-II as set forth in U.S. Pat. Nos. 3,884,794, 3,884,795 and 3,884,796, all incorporated herein by reference. The process may be applied to catalytic or thermal hydroliquefaction processes, including those recited by Garg et al., U.S. Pat. No. 4,472,263, herein incorporated by reference. However, it is preferred that the process of the present invention be applied to non-catalytic, that is, thermal hydroliquefaction processes.

In thermal hydroliquefaction processes, particulate coal is slurried with hydrogen donor solvent and heated, in the presence of hydrogen at elevated temperatures, generally above 350° C. to convert the coal to products of lower molecular weight. Although no catalyst is added, metals already present in the coal may function as catalysts for the process, at least to some extent.

The coal feed, used for hydroliquefaction or solvent refining, is selected from non-anthracitic coals, including bituminous, sub-bituminous and lignite coals. Peat and similar organic feedstocks may also be used in these processes. The coals used as feed may be wet or dry, that is, containing less than about 5% by weight of water. When wet coals are used as feed for the process, the temperature at which the extraction is done is selected so that water can be removed and the solvent system is chosen accordingly.

The binary solvent mixture, used for extraction of the coal feed before hydroliquefaction, is a mixture of an aromatic hydrocarbon of up to 9 carbon atoms and an alkanol of up to 6 carbon atoms. The aromatic hydrocarbon component can be selected from among benzene, toluene, ethylbenzene, the various xylenes, propylbenzenes, methylethylbenzenes and trimethylbenzenes. The alkanol component of the mixture can be selected from methanol, ethanol, and the various isomeric forms of alcohols of 3–6 carbon atoms.

The binary solvent mixture can comprise any proportions of the solvents selected. Generally, the mixture should contain at least 1% by weight of the minor component. Preferred solvent combinations are those containing, as aromatic component benzene or toluene; and, as the alkanol component, methanol, ethanol, n-propanol or isopropanol. A most preferred binary solvent mixture is ethanol and benzene.

The boiling point of the solvent mixture can be kept constant by selection of a binary azeotrope of aromatic hydrocarbon and alkanol. Compositions of representative azeotropes include benzene:methanol 61:39 by weight, boiling at 58° C.; benzene:n-propanol 83:17, boiling at 77° C.; benzene:ethanol; 68:32, boiling at 68° C.; toluene:methanol 71:29, boiling at 64° C. and toluene:ethanol 68:32, boiling at 77° C., all at 760 mm. Most preferred for utilization in the practice of this invention is the benzene:ethanol azeotropic mixture.

The solvent used in solvent refining processes is a hydrogen donor solvent, boiling above about 230° C. Although the solvent is conveniently derived from the coal feed being liquefied, it is feasible to use hydrogen donor solvents of the proper boiling range, obtained from petroleum, shale or tar sands. It will be understood that, in processes in which solvent is recycled, solvents of other origin will gradually be replaced by coal-derived solvent. The coal-derived solvent will normally contain 85–90% by weight of carbon, 8–10% of hydrogen and varying amounts of nitrogen, oxygen and sulfur. The nitrogen may be present in the form of pyridine, carbazole or aniline and the oxygen as aromatic ethers or phenolic materials. In general, solvent used for hydroliquefaction will be selected among those having a boiling range of 230°–455° C.

The coal feed can be extracted by passing extraction solvent through a body of coal, for example, through a fixed bed of coal feed. Alternatively, for laboratory studies, the coal can be placed in the thimble of a Soxhlet extractor, fitted out with a reflux condenser, and the solvent heated under reflux. For larger scale operations, any kind of process commonly used for leaching dispersed fine solids is acceptable. These processes include (1) agitation of batches of feed in tanks to accomplish extraction, followed by settling, decantation, filtration, centrifugation, thickening, etc. to remove solids; and (2) continuous solid/liquid extraction in apparatus designed especially for finely-dispersed solids, e.g., vertical-plate column extraction devices in which solids and extracting solvents are fed continuously into the column in countercurrent flow and withdrawn from the column in countercurrent flow.

The coal feed is extracted with the solvent mixture for at least 10 min. The time selected for extraction will be determined by the boiling point of the solvent mixture, the pressure at which the extraction is carried out and the particle size and porosity of the coal feed being extracted, among other factors. Extraction with a Soxhlet extractor under laboratory conditions is normally done for 24–48 h to assure complete extraction, since this technique does not permit rapid leaching. Extraction done in commercially-available extractors with good agitation rates would permit extraction of coal within a few hours. Extraction using an azeotropic solvent system as a supercritical fluid would be completed within a few minutes. A practical maximum period for extraction is about 72 h.

The temperature at which the feed is extracted is elevated, but is substantially below the temperature at which significant amounts of coal depolymerization or liquefaction occur. The extraction temperature can range from 35° C. to 300° C. Preferred temperatures will depend upon the solvent mixture used and upon whether the extraction is carried out under elevated pressures. Generally, it is preferred to use ambient pressure, so that, for most of the binary solvent systems of interest, the extraction temperature will be below 100° C.

The extraction can be done at atmospheric or elevated pressures. However, elevated pressures, particularly those approaching or exceeding critical conditions for the solvent mixture employed, are unnecessary, although the use of higher pressures may increase the extraction efficiency in the separator.

The atmosphere during the extraction step can be air or an inert gas, e.g., nitrogen or helium. The extraction can be done either in a batch process or continuously.

The extracted coal may be transferred from the extractor to the liquefaction reactor under pressure, from about $1.4\times10^5$ to $3.5\times10^6$ kg/m$^2$. If the extraction was done under an inert atmosphere, hydrogen can be added to the feed before transfer to the hydroliquefaction reactor or can be added directly to the liquefaction reactor.

A further process in accordance with the invention is one wherein coal feed is heated with hydroliquefaction solvent at 50°–100° C. for 0.25–5 h before extraction with the binary solvent mixture. Yields of oil fraction and coal conversion are higher than for unextracted coal.

The extracted feed, hydrogen donor solvent and hydrogen can also be preheated in a preheater to the desired reaction temperature. It is preferred that the outlet temperature of the preheater is 375°–455° C., more preferably 375°–425° C., and that the temperature in the hydroliquefaction reactor is 400°–485° C. The residence time of the extracted coal in the hydroliquefaction reactor is 5–300 minutes, preferably 5–60 minutes. The hydrogen flow rate is normally 62.4–936 m$^3$/metric ton. Hydrogen used in the preheater can also contain hydrogen sulfide.

It will be understood that a number of chemical transformations take place in the hydroliquefaction reactor. The preferred cnversions include those of coal to distillate oil. Products from the hydroliquefaction reactor are passed through a gas-liquid separator to recover product gases and unused hydrogen, which is recycled. The condensed phase is further treated to recover net distillate products and process solvent, part of which may be withdrawn as a net distillate oil product. More particularly, product is withdrawn as $C_1$–$C_5$ hydrocarbon gases and oil (bp 150°–455° C.) fractions.

Recovered process solvent can be recycled to the liquefaction step. The distillation bottoms can be further separated to recover unconverted coal, minerals and ash, using methods well known in the art, including filtration, sub-critical and super-critical solvent deashing, and anti-solvent deashing. Deashed and demineralized distillation bottoms are identified as solvent-refined coal (SRC), a solid at room temperature, which is withdrawn as net product. The SRC can be used as a feedstock for making anode coke, used as boiler fuel, or reprocessed to make additional distillate oil. The residue containing unconverted coal, minerals and ash can be gasified to make hydrogen.

It is postulated that the advantages achieved by utilization of the extraction pretreatment occur because aromatic hydrocarbons alone do not adequately penetrate the microporous structure of the coal. Extraction of coal with a typical aromatic hydrocarbon solvent, benzene, did not improve the yield of oil in the hydroliquefaction products. It is proposed that the lower alkanols, particularly methanol and ethanol, which are not particularly good extracting solvents, are effective in swelling the pores of the coal feed and increasing accessability of the microporous structure to the aromatic hydrocarbon solvent and to the hydrogen donor solvent used in the later liquefaction step.

Although the foregoing gives a proposed theoretical explanation of the mechanism by which the present invention operates, it will be understood that the inventor does not wish to be bound by such explanation and relies on the appended claims to define the invention.

In FIG. 1 is shown schematically a preferred process in accordance with the invention. Raw coal feed is introduced through feed line 1 into the pretreatment reactor and mixed in the pretreatment reactor with extracting binary solvent mixture from line 2. The extracted mixture is transferred through transfer line 3 to the first stage separator, in which the binary solvent-coal mixture is separated into an extract and coal. The extract is removed through line 4 and is further processed to yield extract residue, which is removed from the system, and recovered binary solvent, which can be returned to the pretreatment reactor through line 2. The extract residue fraction can either be sent to the liquefaction reactor through line 9 or transferred to means for upgrading by hydroprocessing through line 8.

The insoluble extracted coal residue is transferred through transfer means 6, in which it is mixed with recycle hydrogen donor process solvent from line 10 and fed to the liquefaction reactor. The liquefaction reactor is also provided with means for introducing hydrogen. The liquefaction reactor is typically operated at temperatures of 350°–450° C. and under elevated hydrogen pressures. The effluent from the liquefaction reactor is transferred through line 12 to a second stage separator, in which light gases are removed through line 11. The liquid residue is distilled to yield an oil distillate fraction, removed through line 13, and an underflow product, consisting of SRC and residue. The latter is removed through line 14. The distillate product is further treated to recover solvent, which is recycled to the liquefaction reactor through 10. —

BEST MODE FOR CARRYING OUT THE INVENTION

Figure 1:
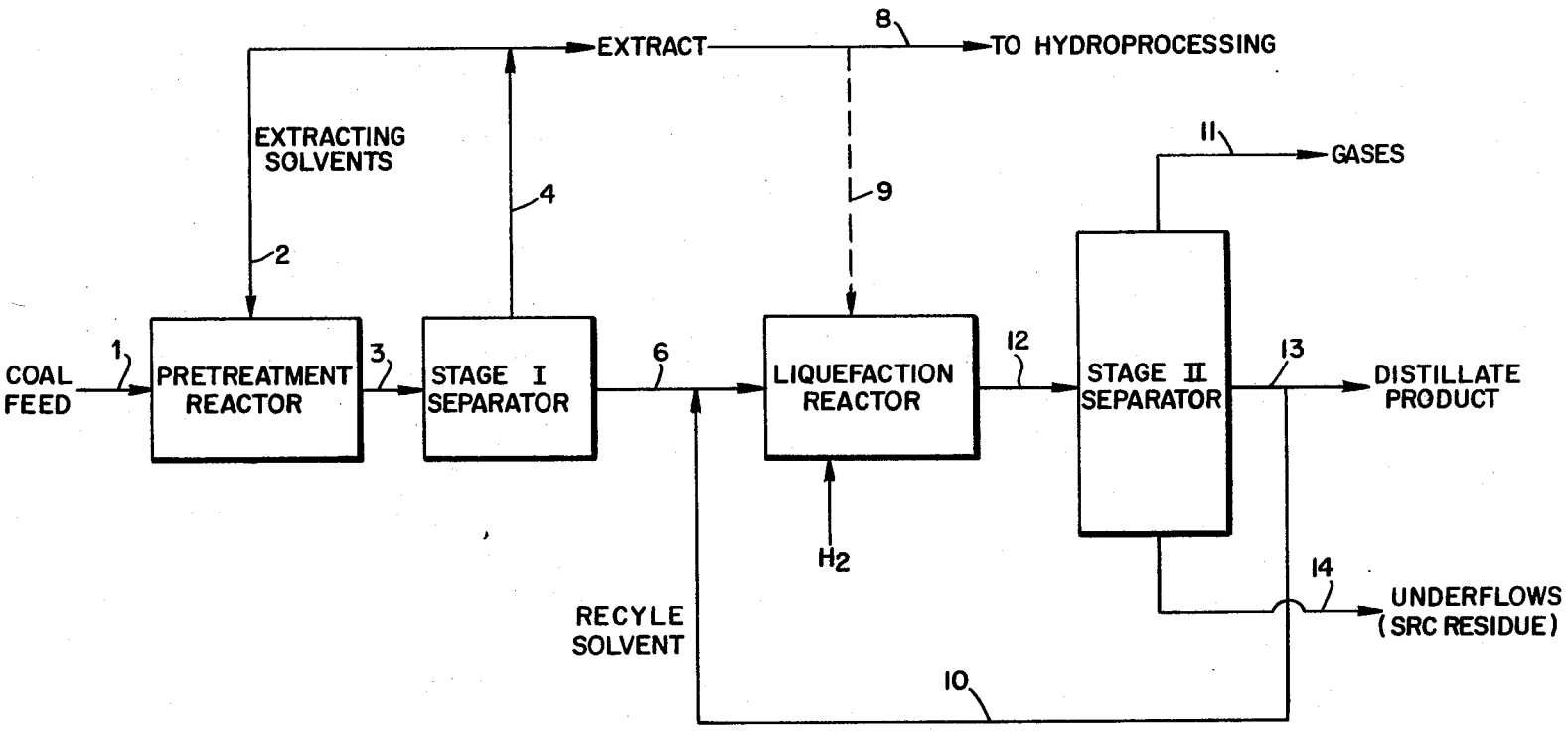
In FIG. 1 is shown a schematic representation of a preferred embodiment of the invention.

In a most preferred aspect, the process of the invention is that wherein extraction of coal feed is carried out with an azeotropic mixture of benzene and ethanol at atmospheric pressure.

Without further elaboration, it is believed that one skilled in the art can, using the preceding description, utilize the present invention to the fullest extent. The following preferred specific embodiments are, therefore, to be construed as merely illustrative and not limitative of the remainder of the disclosure in any way whatsoever.

In the following examples, temperatures are set forth uncorrected in degrees Celsius. Unless otherwise indicated, all parts and percentages are by weight.

EXAMPLE 1

Solvent Extraction of Illinois no. 6 Coal (a) Preparation of Coal Sample

Illinois no. 6 bituminous coal was initially cleaned at the mine and pulverized to −200 mesh with a gas swept mill. The elemental composition of dry and MAF coal is given in Table 1.

(b) Extraction with Benzene-ethanol Mixture

A 50-g sample of coal was placed in the thimble of a Soxhlet extractor to which was charged 600 ml of an azeotropic benzene-ethanol mixture (67.6:32.4 by volume). The coal was extracted with the boiling solvent mixture for 48 h. The extract was collected by evaporation of the solvents. The yield of extract was 9.3% by weight for a first run and 10.1% by weight for a second run.

The extracted coal was dried under vacuum at 70° C. to remove residual solvent and weighed.

The composition of solvent-free extract is given in Table 1. The extract was richer in hydrogen than the initial coal feed and the content of compounds containing heteroatoms was somewhat lower in the extract, than in the coal feed.

(c) Extraction with Benzene

A sample of Illinois no. 6 coal (60 g) was extracted with 600 ml of benzene for 72 h. The yield of dry extract, after removal of solvent, was 2.7%, based on MAF coal.

TABLE 1

ANALYSIS OF FEED COAL AND EXTRACT USING BENZENE-ETHANOL MIXTURE

| | Illinois #6 Coal | | Benzene/ Ethanol Extract |
|---|---|---|---|
| | % Dry | % MAF | % MAF |
| Carbon | 66.92 | 75.18 | 81.35 |
| Hydrogen | 4.79 | 5.38 | 6.38 |
| Oxygen* | 11.65 | 13.09 | 8.52 |
| Nitrogen | 1.28 | 1.44 | 1.21 |
| Sulfur | 3.53 | 3.97 | 2.16 |
| Ash | 10.99 | — | — |

Direct determination (d) Extraction with Ethanol

Illinois no. 6 coal (50 g) was extracted with 600 ml of absolute ethanol for 7 days. The yield of extract, determined as above, was less than 2%, based on MAF coal.

EXAMPLE 2

Liquefaction of Illinois no. 6 Coal (as received)

Coal (−200 mesh, 3 g) was mixed with 6 g of coal-derived process solvent (Wilsonville recycle solvent, WRS-96, bp range 232°–482° C.). The resulting mixture was charged to a 50-ml tubing bomb, which was pressurized to $5.97\times10^5$ kg/m$^2$. The mixture was heated at 425° C. for 1 hr. After the reaction was quenched, a gas fraction was removed and the product slurry was extracted with n-pentane to obtain an oil fraction (n-pentane soluble). The n-pentane insoluble material was extracted with a mixture of methylene chloride and methanol to obtain a soluble fraction, solvent refined coal (SRC) and an insoluble fraction (IOM). The IOM residue was weighed to determine overall coal conversion.

Results for each of two duplicate runs are given in Table 2, from which it is apparent that the yield of oil was about 12.5%.

EXAMPLE 3

Liquefaction of Benzene-extracted Illinois no. 6 Coal

A sample of benzene-extracted Illinois no. 6 coal from Example 1(c) was subjected to liquefaction as in Example 2. Results, given in Table 2, indicate that benzene-extracted coal gave a lower yield of oil and lower conversion than unextracted coal.

EXAMPLE 4

Liquefaction of Ethanol-extracted Illinois no. 6 Coal

Ethanol-extracted Illinois no. 6 coal from Example 1(d) was subjected to liquefaction as in Example 2. Yields of products are given in Table 2. Yields of oil and overall conversion were lower than for unextracted Illinois no. 6 coal.

TABLE 2

LIQUEFACTION OF EXTRACTED COAL AND ORIGINAL COAL

| | Example 2 Original Illinois #6 Coal | | Example 3 Benzene-Extracted Illinois #6 Coal | Example 4 Ethanol-Extracted Illinois #6 Coal | Example 5 Benzene-Ethanol Extracted Illinois #6 Coal (a) Extracted-Coal Basis | Example 5 Benzene-Ethanol Extracted Illinois #6 Coal (b) Whole-Coal Basis |
|---|---|---|---|---|---|---|
| Temperature, °C. | 425 | 425 | 425 | 425 | 425 | |
| $H_2$ Pressure, kg/m$^2$ × $10^{-4}$ | 59.7 | 59.7 | 59.7 | 59.7 | 59.7 | |
| Reaction Time, min. | 60 | 60 | 60 | 60 | 60 | |
| Conversion, (wt % daf) | 82.3 | 82.0 | 73.1 | 70.1 | 78.0 | 80.4 |
| Product Distribution (wt % daf) | | | | | | |
| Gases[a] | 7.8 | 8.3 | 8.5 | 8.7 | 6.8 | 6.1 |
| Oils[b] | 14.5 | 10.5 | 9.8 | 9.8 | 17.5 | 22.6 |
| SRC[c] | 60.0 | 64.3 | 54.8 | 51.5 | 53.7 | 51.4 |
| IOM[d] | 17.7 | 18.0 | 26.9 | 30.0 | 22.0 | 19.9 |

[a] $C_1$–$C_5$ hydrocarbons, hydrogen sulfide, ammonia, CO and carbon dioxide
[b] soluble in n-pentane
[c] insoluble in n-pentane and soluble in methylene chloride/methanol (90:10 by volume) mixture
[d] insoluble in n-pentane and methylene chloride/methanol mixture

EXAMPLE 5

Liquefaction of Illinois no. 6 Coal, Extracted with Benzene-ethanol Mixture

Coal extracted with a benzene-ethanol mixture as in Example 1(b) was subjected to liquefaction as in Example 2. The product distribution is given in Table 2, for both extracted coal and coal as received. These results show that coal extracted with the benzene-ethanol mixture before liquefaction gave significantly higher yields of oil, particularly when the weight of benzene-ethanol extract was taken into account (Example 5, col. b in Table 2), than unextracted coal.

EXAMPLE 6

Conditioning Coal with Recycle Solvent before Extraction

Ilinois no. 6 coal (15 g) was heated at 70° C. for 1 hr with middle distillate coal-derived recycle solvent (bp 176°–343° C.) and then extracted with the benzene-ethanol mixture of Example 1(b) in a Soxhlet apparatus for 48 h. The yield of extract, discounting recovered process solvent, was 9.5% by weight.

The thus-extracted coal was subjected to liquefaction at 425° C. as in Examples 2–5. Results, given in Table 3 and compared to results of Example 5 (extracted coal basis), indicate that treatment with process solvent before extraction with the binary solvent mixture, also gives much higher yields of oil than obtained for untreated coal.

EXAMPLE 7

(a) Extraction of Coal with Toluene-ethanol Azeotropic Mixture

Illinois no. 6 coal is extracted with a toluene:ethanol azeotropic mixture (68:32 by weight, boiling at 77° C. at 760 mm) by heating under reflux as in Example 1(b). Similar results are obtained upon liquefaction of the extracted coal as in Examples 2–5.

(b) Extraction of Coal with Benzene-methanol Azeotropic Mixture

Illinois no. 6 coal is extracted with a benzene-methanol azeotropic mixture (61:39 by weight, boiling at 58° C. at 760 mm) by heating under reflux as in Example 1(b). Similar results are obtained following liquefaction of the extracted coal as in Examples 2–5.

TABLE 3

LIQUEFACTION OF SOLVENT-TREATED, BENZENE-ETHANOL EXTRACTED COAL

| | Example 5 Benzene-Ethanol Extracted | Example 6 Mid-Distillate Treated, Benzene-Ethanol Extracted |
|---|---|---|
| Product Distribution (wt % daf) | | |
| Gases[a] | 6.8 | 7.5 |
| Oils[b] | 17.5 | 19.2 |
| SRC[c] | 53.7 | 54.2 |
| IOM[d] | 22.0 | 19.1 |
| Conversion (% daf) | 78.0 | 80.9 |

[a]$C_1$–$C_5$ hydrocarbons, hydrogen sulfide, ammonia, CO and carbon dioxide
[b]soluble in n-pentane
[c]insoluble in n-pentane and soluble in methylene chloride/methanol mixture
[d]insoluble in n-pentane and methylene chloride/methanol mixture (c) Extraction of Coal with Benzene-isopropanol Azeotropic Mixture Illinois no. 6 coal is extracted by a refluxing mixture of benzene-isopropanol (66:34 by weight, boiling at 72° C. at 760 mm) as in Example 1(b). Similar results are obtained upon liquefaction of the extracted coal as in Examples 2–5.

I claim:

1. In a process for solvent refining of coal at an elevated temperature and pressure in the presence of hydrogen and a hydrogen donor solvent to produce liquid hydrocarbons and normally solid solvent-refined coal, the improvement comprising extracting a coal feed with a binary mixture of an aromatic hydrocarbon of up to 9 carbon atoms and an alkanol of up to 6 carbon atoms at a temperature below about 300° C., before solvent refining the coal.

2. The process of claim 1, wherein solvent refining is a thermal process.

3. The process of claim 1, wherein solvent refining is a catalytic process.

4. The process of claim 1, wherein the binary mixture is an azeotropic mixture at the pressure utilized.

5. The process of claim 1, wherein the aromatic hydrocarbon is benzene.

6. The process of claim 1, wherein the aromatic hydrocarbon is toluene.

7. The process of claim 1, wherein the alkanol is methanol.

8. The process of claim 1, wherein the alkanol is ethanol.

9. The process of claim 1, wherein the alkanol is isopropanol.

10. The process of claim 1, wherein the binary mixture is an azeotropic mixture of benzene and ethanol and the coal feed is extracted with the binary mixture under reflux at atmospheric pressure.

11. The process of claim 1, wherein the binary mixture is an azeotropic mixture of benzene and ethanol; the coal feed is extracted with the binary mixture under reflux at atmospheric pressure and the solvent refining process is a thermal process.

12. The process of claim 1, including the further step of recovering binary mixture from the thus-extracted coal and recycling binary mixture to extract further coal feed.

13. The process of claim 1, wherein the coal feed is conditioned with solvent refining process solvent at 50°–100° C. for 0.25–5 h before extraction with the binary mixture.

14. The process of claim 1, wherein the coal feed is extracted with the binary mixture for at least 10 min.

15. The process of claim 1, wherein the coal feed is extracted with an azeotropic mixture of benzene and ethanol at atmospheric pressure at the boiling point of the mixture for at least 10 min.

16. The process of claim 1, wherein the coal feed is extracted with an azeotropic mixture of benzene and ethanol at the boiling point of the mixture under atmospheric pressure for at least 10 min and the solvent refining process is a thermal process.

17. The process of claim 1, wherein the coal feed is extracted with the binary mixture of aromatic hydrocarbon and alkanol at a temperature below 100° C.

* * * * *